US006694891B1

(12) United States Patent
Lai

(10) Patent No.: US 6,694,891 B1
(45) Date of Patent: Feb. 24, 2004

(54) FOLDABLE DESK

(76) Inventor: Hsiu-Chen Lai, No. 1, Lane 150 Chang-Lu Rd., Chang Hua City (TW)

( * ) Notice: Subject to any disclaimer, the term of this patent is extended or adjusted under 35 U.S.C. 154(b) by 55 days.

(21) Appl. No.: 10/082,726

(22) Filed: Feb. 26, 2002

(51) Int. Cl.[7] ..... A47F 5/12

(52) U.S. Cl. ..... 108/6; 248/292.13; 248/150; 108/116

(58) Field of Search ..... 108/50.02, 6, 7, 108/115, 116, 147.19, 147.2, 147.22, 150; 248/291.1, 292.12, 292.13, 150, 166, 439; 297/461, 451.5

(56) References Cited

U.S. PATENT DOCUMENTS 3,199,825 A * 8/1965 Bellows ..... 248/397
4,248,161 A * 2/1981 Adair et al. ..... 108/6
4,383,486 A * 5/1983 Reineman et al. ..... 108/2
4,728,065 A * 3/1988 Coote ..... 248/129
4,886,297 A * 12/1989 Levine ..... 280/809
5,456,431 A * 10/1995 Ilnisky ..... 248/98
5,799,919 A * 9/1998 Orr ..... 248/398
6,481,913 B2 * 11/2002 Chen ..... 403/83

* cited by examiner

*Primary Examiner*—Janet M. Wilkens
(74) *Attorney, Agent, or Firm*—Harrison & Egbert

(57) ABSTRACT

A foldable desk includes a desk top, a support post, and a base. The support post is formed of an outer tube and an inner tube slidably received in the outer tube. The desk top is provided with a retaining block, which is disengageably meshed with a retaining block of the top end of the inner tube of the support post. The outer tube is provided at the bottom end with a support seat which is rotatably fastened to the base in conjunction with a locating member.

3 Claims, 7 Drawing Sheets

FOLDABLE DESK

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a desk, and more particularly to a foldable desk.

BACKGROUND OF THE INVENTION

Conventional desks are generally not foldable and therefore, cannot be easily stored or transported. Conventional desks must be versatile in design in order to enhance their appeal to consumers at large.

BRIEF SUMMARY OF THE INVENTION

The primary objective of the present invention is to provide a foldable desk comprising a desk top, a support post, and a base. The desk top is foldably mounted on the top end of the support post. The support post is provided at the bottom end with a support seat by means of which the bottom end of the support post is foldably mounted on the base.

The features and the advantages of the present invention will be more readily understood upon a thoughtful deliberation of the following detailed description of the present invention with reference to the accompanying drawings.

DETAILED DESCRIPTION OF THE INVENTION

Figure 1:
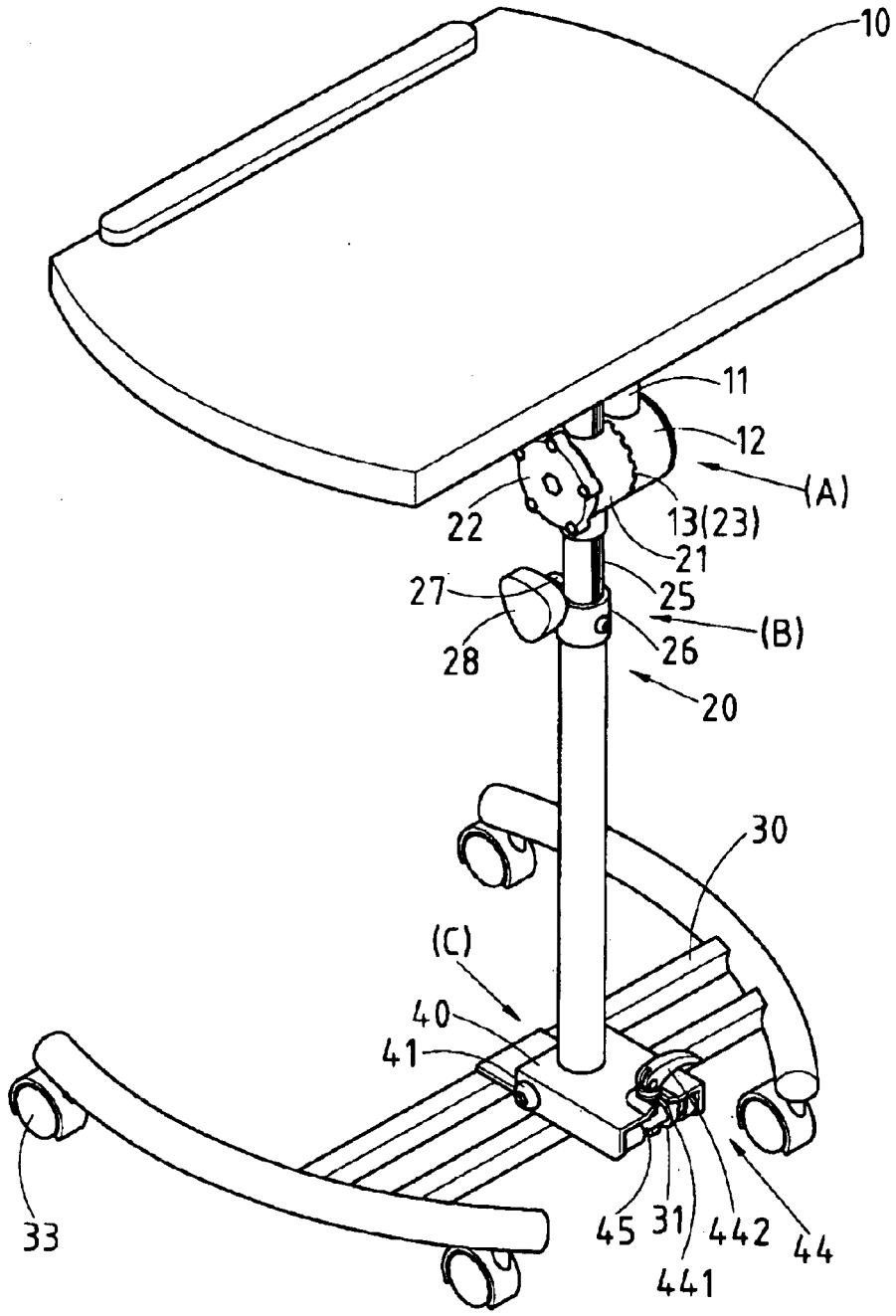
FIG. 1 shows a perspective view of the present invention.
Figure 2:
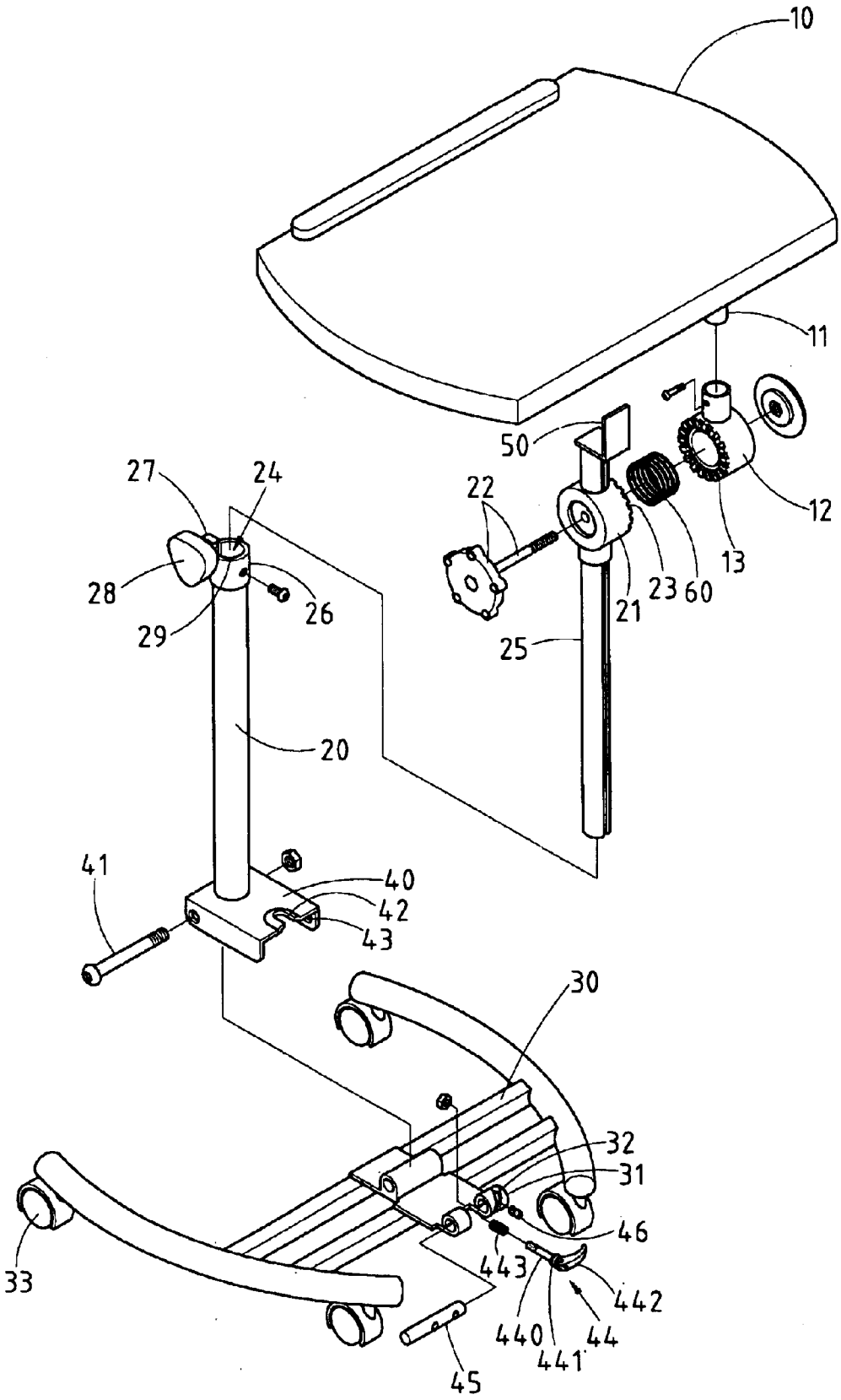
FIG. 2 shows an exploded view of the present invention.

As shown in all drawings provided herein, a foldable desk of the present invention comprises a desk top 10, a support post 20, and a base 30. The desk top is mounted on the top end of the support post 20. The support post 20 is mounted at the bottom end on the base 30.

The desk top 10 is provided with a locating portion "A" comprising a support rod 11, and a retaining block 12 with an engagement portion 13.

The support post 20 is provided at the top end with a first locating portion "B" comprising a retaining block 21 with an engagement portion 23, a hollow outer tube 24, an inner tube 25 slidably received in the hollow outer tube 24, a fastening ring 26 with an opening 29 and an adjustment knob 28. The retaining block 21 is fastened with the top end of the inner tube 25. The inner tube 25 is slidably received in the outer tube 24 for adjusting the level of the desk tip 10.

The support post 20 is provided at the bottom end with a second locating portion "C" comprising a support seat 40 and a pivot 41 by means of which the support seat 40 is pivotally fastened with the base 30. The support seat 40 is provided with a locating slot 42 and a locating hole 43.

The base 30 is fastened to a locating member 44 and is provided with two lugs 31, one of which is provided with an inclined guide hole 32. The locating member 44 is provided with a rod 440, a press block 441, an eccentric knob 442. The rod 440 is vertically fastened to a retaining rod 45 which is rotatably received in the lugs 31 of the base 30. A spring 443 is disposed between the press block 441 and the retaining rod 45. The retaining rod 45 is provided with a projection 46, which is slidably received in the inclined guide hole 32. The support seat 40 is fastened to the base 30 such that one end of the retaining rod 45 is fitted into the locating hole 43 of the support seat 40, and such that the press block 441 of the locating member 44 is located in the locating slot 42 of the support seat. As the eccentric knob 442 is turned, the press block 441 is pressed against so as to cause the support seat 40 to fastened with the base 30.

The desk top 10 is foldably fastened with the support post 20 by a fastening bolt 22 which is used to fastened the retaining block 12 of the desk top 10 and the retaining block 21 of the support post 20 such that the engagement portion 13 of the retaining block 12 of the desk top 10 is engaged with the engagement portion 23 of the retaining block 21 of the support post 20.

The support post 20 is further provided at the top end with a stop piece 50 for confining the support rod 11 of the desk top 10 at the time when the desk top 10 is located horizontally.

The base 30 is provided with a plurality of wheels 33 to facilitate the moving of the desk on a surface.

The retaining block 12 of the desk top 10 and the retaining block 21 of the support post 20 are fastened together by the fastening bolt 22 in conjunction with a spring 60 which is disposed between the retaining block 12 of the desk top 10 and the retaining block 21 of the support post 20.

Figure 3:
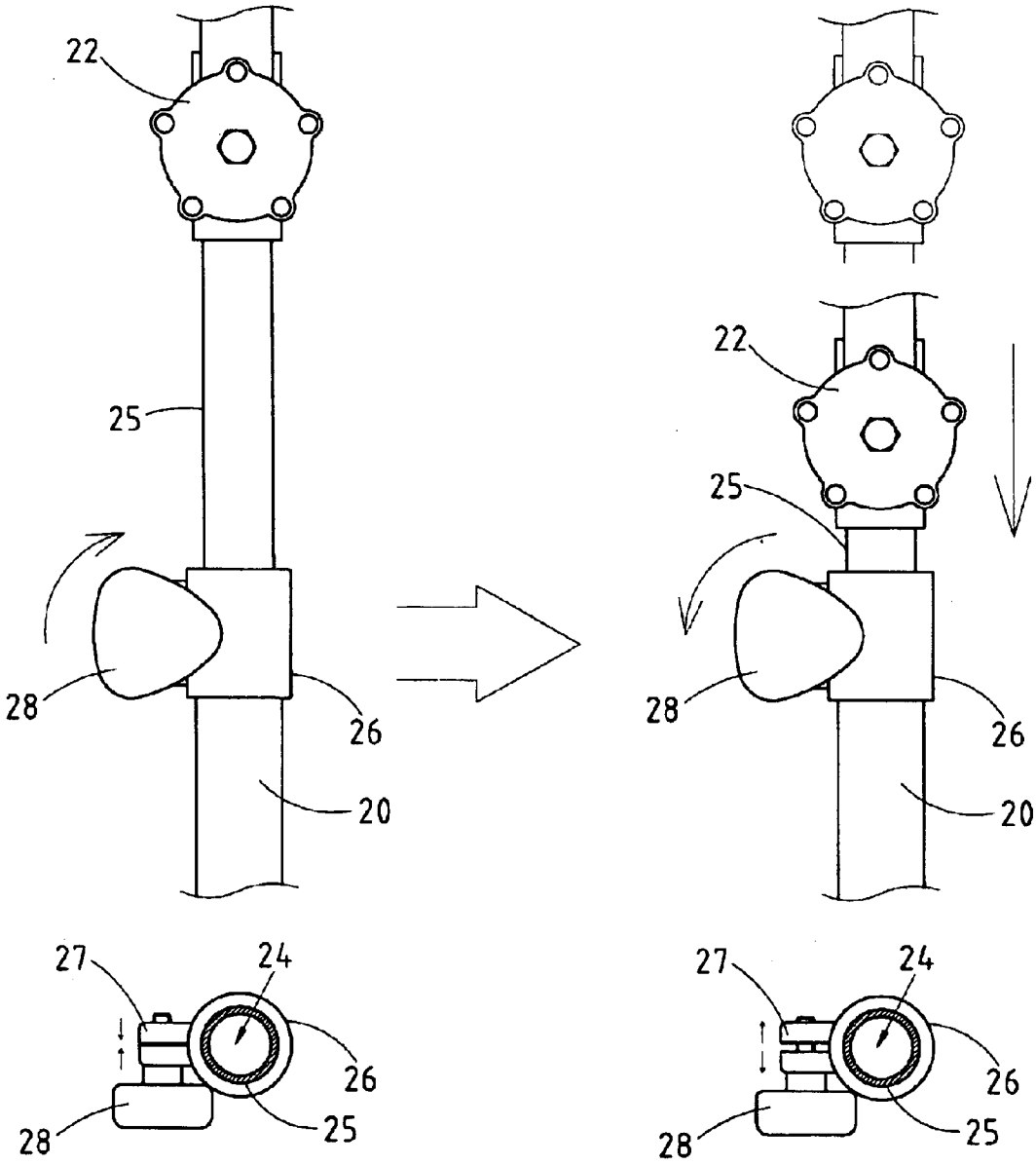
FIGS. 3–7 show alternate schematic views of the folding actions of the present invention.

The inner tube 25 is fixed at a level by turning the adjustment knob 28 against the fastening ring 26, as illustrated in FIG. 3. The desk top 10 is thus fixed at the level.

Figure 4:
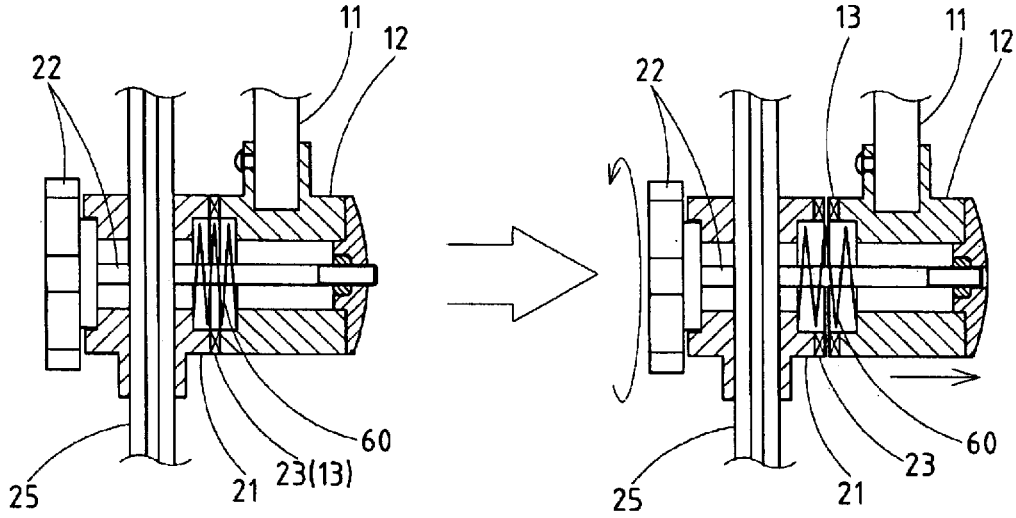
Figure 5:
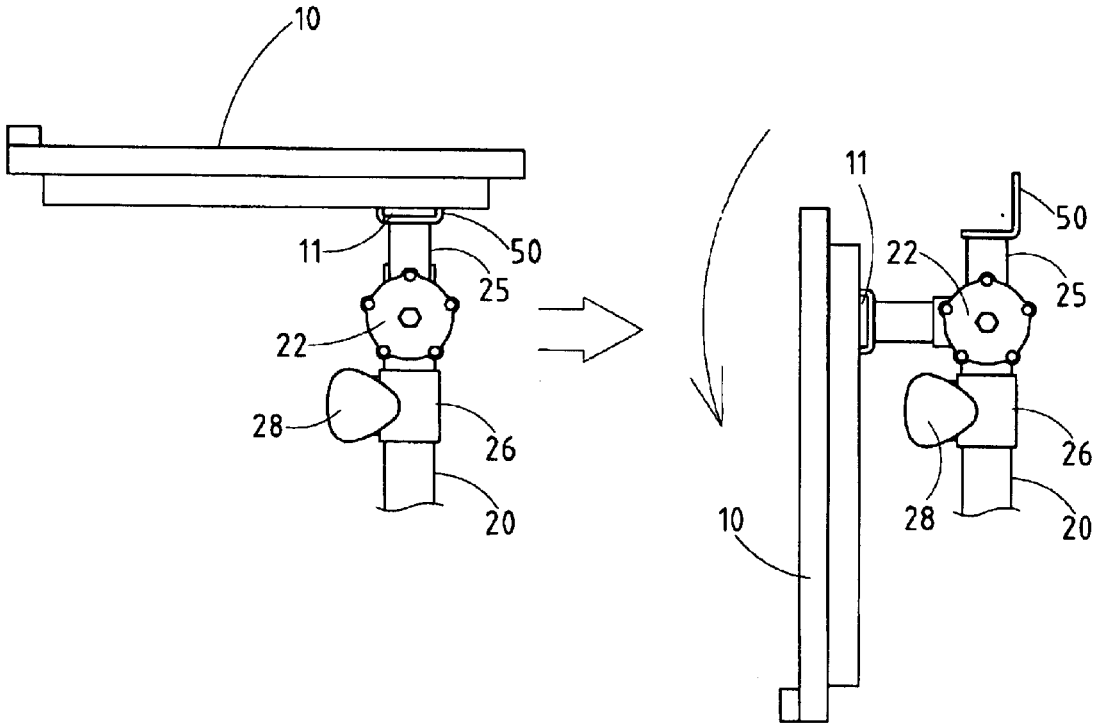

As illustrated in FIGS. 4 and 5, the engagement portion 13 of the retaining block 12 of the desk top 10 is caused to disengage with the engagement portion 23 of the retaining block 21 of the support post 20 by unfastening the fastening bolt 22, thereby enabling the desk top 10 to be turned.

Figure 6:
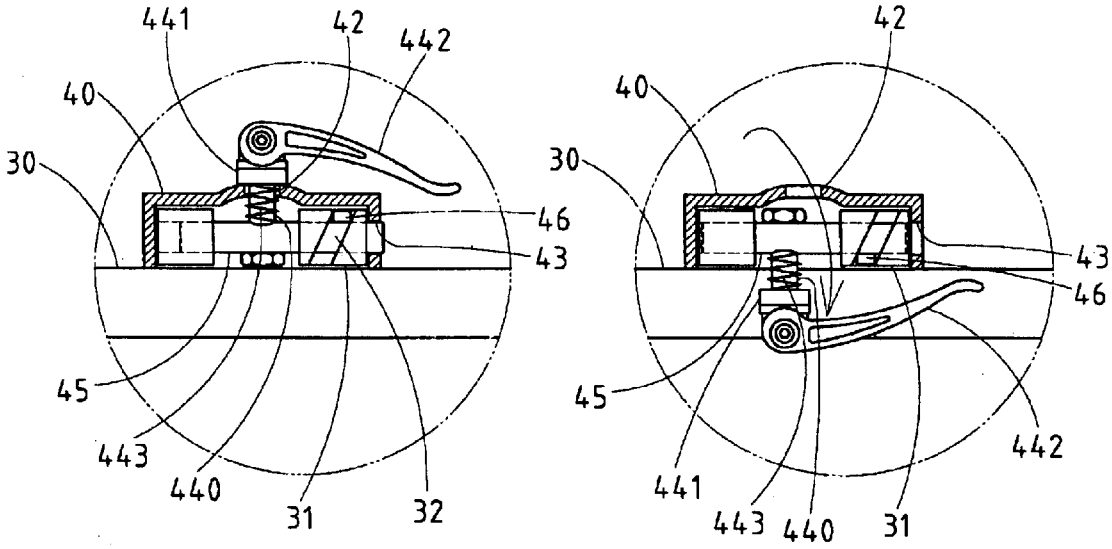
Figure 7:
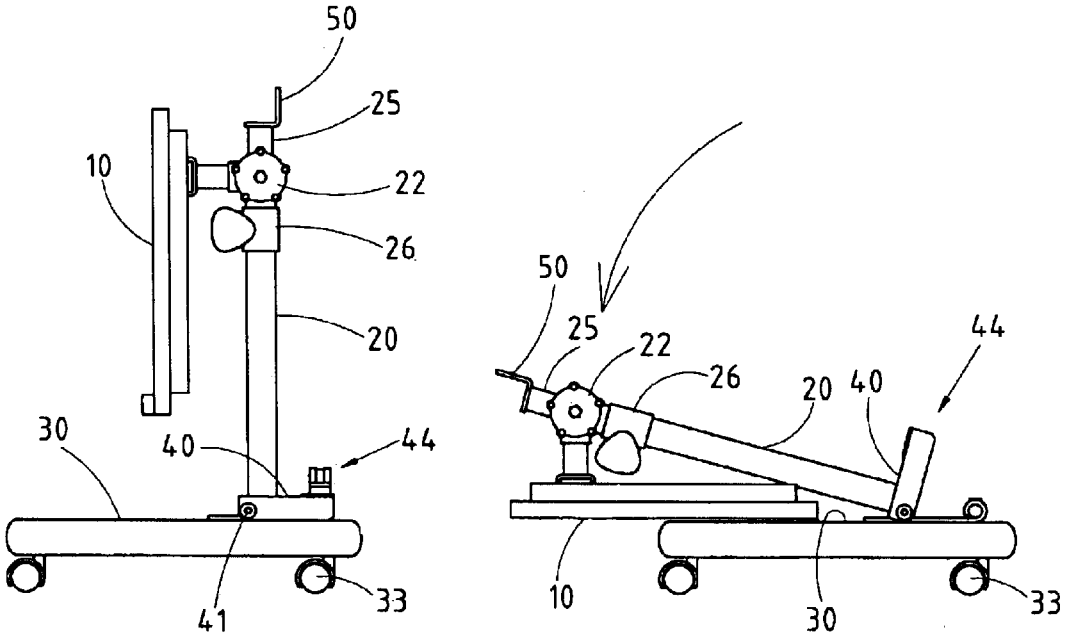

As shown in FIGS. 6 and 7, as the eccentric knob 442 of the locating member 44 is turned upward to cause the press block 441 to move away from the support seat 40, the rod 440 of the locating member 44 can be turned downward to cause the projection 46 of the retaining rod 45 to drive one end of the retaining rod 45 to move out of the locating hole 43 of the support seat 40, thereby enabling the support seat 40 to be turned.

I claim:

1. A foldable desk comprising:

a desk top having a support rod in an underside thereof, said desk top having a retaining block retaining said support rod, said retaining block having an engagement portion;

a support post formed of an outer tube and an inner tube slidably received in said outer tube, said inner tube having a retaining block at a top end thereof, said retaining block of said inner tube having an engagement portion, said inner tube supporting said desk top in such a manner that said retaining block of said inner tube is fastened with said retaining block of said desk top by a fastening bolt, the engagement portions of the retaining blocks of said inner tube and said desk top being disengageably meshed with each other;

a support seat fastened at a bottom end of said outer tube of said support post, said support seat having a locating slot and a locating hole; and a base having a pair of lugs, one of said pair of lugs having an inclined guide hole, said base having a locating member formed of a rod and a press block and an eccentric knob, said locating member rotatably fastening said support seat of said outer tube of said support post by a retaining rod received in said pair of lugs such that one end of said retaining rod is located in said locating hole of said support seat, a projection of said retaining rod being slidably received in said inclined guide hole of one of said pair of lugs, said press block of said locating member being located in said locating slot of said support seat whereby said press block is pressed against by said eccentric knob when said eccentric knob is turned.

2. The foldable desk as defined in claim 1 wherein said base has a plurality of wheels fastened pivotally therewith.

3. The foldable desk as defined in claim 1, wherein said retaining block of said desk top and said retaining block of said inner tube of said support post are fastened together by said fastening bolt in conjunction with a spring whereby said spring is disposed between said retaining block of said desk top and said retaining block of said inner tube of said support post.

* * * * *